US005944975A

United States Patent [19]

Wilson et al.

[11] Patent Number: 5,944,975

[45] Date of Patent: Aug. 31, 1999

[54] METHOD OF FORMING A LIFT-OFF LAYER HAVING CONTROLLED ADHESION STRENGTH

[75] Inventors: Arthur M. Wilson; Chi-Cheong Shen, both of Richardson; Saroja Ramamurthi, Allen, all of Tex.

[73] Assignee: Texas Instruments Incorporated, Dallas, Tex.

[21] Appl. No.: 08/788,149

[22] Filed: Jan. 24, 1997

Related U.S. Application Data

[63] Continuation-in-part of application No. 08/622,081, Mar. 26, 1996, abandoned.

[51] Int. Cl.[6] ..... C25D 5/02; C25D 5/54; C25D 5/10; C23C 28/00

[52] U.S. Cl. ..... 205/122; 205/159; 205/170; 205/183; 205/188; 205/191; 205/198; 205/221; 205/223; 313/309; 313/336; 445/47; 445/50; 216/11; 216/40

[58] Field of Search ..... 205/122, 162, 205/163, 183, 221, 223, 170, 159; 427/126.3, 123, 78, 77; 313/309, 336; 445/50, 47; 216/11, 40

[56] References Cited

U.S. PATENT DOCUMENTS

| | | | |
|---|---|---|---|
| 3,755,704 | 8/1973 | Spindt et al. | 313/309 |
| 4,129,482 | 12/1978 | Lash | 204/43 T |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,394,006 | 2/1995 | Liu | 257/506 |
| 5,458,520 | 10/1995 | DeMercurio et al. | 445/24 |
| 5,679,044 | 10/1997 | Meyer et al. | 445/24 |

*Primary Examiner*—Kathryn Gorgos
*Assistant Examiner*—Edna Wong
*Attorney, Agent, or Firm*—Rose Alyssa Keagy; Robby T. Holland; Richard L. Donaldson

[57] ABSTRACT

A method of fabricating an emitter plate 12 for use in a field emission device comprising the steps of providing an insulating substrate 18 and forming a first conductive layer 13 on the insulating substrate 18. This is followed by the steps of forming an insulating layer 20 on the first conductive layer 13 and forming a second conductive layer 22 on the insulating layer 20. Then, a plurality of apertures 34 are formed through the second conductive layer 22 and through the insulating layer 20. A lift-off layer 36 is then formed on the second conductive layer 22. The lift-off layer 36 is formed by a plating process wherein the plating bath has a pH between 2.25 and 4.5, and current densities of 1 to 2O mA/cm$^2$. The method may further comprise depositing conductive material through the plurality of apertures 34 to form a microtip 14 in each of the plurality of apertures 34. The excess deposited conductive material 14' and the lift-off layer 36 are then removed from the second conductive layer 22.

18 Claims, 3 Drawing Sheets

METHOD OF FORMING A LIFT-OFF LAYER HAVING CONTROLLED ADHESION STRENGTH

RELATED APPLICATIONS

This is a continuation-in-part of co-assigned, nonprovisional, U.S. patent application Ser. No. 08/622,081, filed Mar. 26, 1996 now abandoned, "Method Of Forming a Lift-Off Layer Having Controlled Adhesion Strength" (Texas Instruments Docket No. TI-20924).

TECHNICAL FIELD OF THE INVENTION

The present invention relates generally to the manufacture of flat panel displays and, more particularly, to a method for improving the formation of the microtips by efficiently removing the overburden microtip material.

BACKGROUND OF THE INVENTION

For more than half a century, the cathode ray tube (CRT) has been the principal electronic device for displaying visual information. The widespread usage of the CRT may be ascribed to the remarkable quality of its display characteristics; namely, color, brightness, contrast and resolution. One major feature of the CRT permitting these qualities to be realized is the use of a luminescent phosphor coating on a transparent faceplate.

Conventional CRT's, however, have the disadvantage that they require significant physical depth, i.e., space behind the actual display surface, making them bulky and cumbersome. They are fragile and, due in part to their large vacuum volume, can be dangerous if broken. Furthermore, these devices consume significant amounts of power.

The advent of portable computers has created intense demand for displays which are light-weight, compact and power efficient. Since the space available for the display function of these devices precludes the use of a conventional CRT, there has been significant interest in efforts to provide satisfactory so-called "flat panel displays" having comparable or even superior display characteristics, e.g., brightness, resolution, versatility in display, power consumption, etc.

Currently, liquid crystal displays (LCD's) are used almost universally for laptop and notebook computers. In comparison to a CRT, these displays provide poor contrast, only a limited range of viewing angles, and, in color versions, they consume power at rates which are incompatible with extended battery operation. In addition, color screens tend to be far more costly than CRT's of equal screen size.

As a result of the drawbacks of liquid crystal display technology, thin film field emission display technology has been receiving increasing attention by industry. Flat panel displays utilizing such technology employ a matrix-addressable array of pointed, cold field emission microtips in combination with an anode comprising a phosphorluminescent screen. The phenomenon of field emission was discovered in the 1950's, and extensive research by many individuals, such as Charles A. Spindt of SRI International, has improved the technology to the extent that its use in the manufacture of inexpensive, low-power, high-resolution, high-contrast, full-color flat displays has been realized.

Advances in field emission display technology are disclosed in U.S. Pat. No. 3,755,704, "Field Emission Cathode Structures and Devices Utilizing Such Structures," issued Aug. 28, 1973, to C. A. Spindt et al.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robert Meyer; and U.S. Pat. No. 5,225,820, "Microtip Trichromatic Fluorescent Screen," issued Jul. 6, 1993, to Jean-Frédéric Clerc. These patents are incorporated by reference into the present application.

The conventional process for forming the microtips in the emitter plate of the flat panel display is taught by the Spindt et al. ('704) patent. This process involves forming a sacrificial layer, called a lift-off layer, on the surface of the gate using low angle evaporation techniques well known in the industry. The lift-off layer is illustratively nickel. The microtips are formed by evaporation, at a normal angle, of the tip metal into the holes formed in the gate metal and underlying insulator material. The tip metal is illustratively molybdenum. The lift-off layer is then dissolved by an electrochemical process which then exposes the gate metal and the microtips.

There are many disadvantages associated with forming the lift-off layer using low angle evaporation. First, the long throw angle dictates the need for a very large evaporation chamber. The use of large evaporation chambers slows the manufacturing time of flat panel displays because opening the large chamber doors to load the emitter plates exposes the whole chamber to atmospheric pressure. The increase in manufacturing time increases the cost of the flat panel display and therefore reduces the ability to compete in price in the marketplace.

In view of the above, it is clear that there exists a need for an improved microtip deposition process. More specifically, what is needed is a microtip deposition process which overcomes the disadvantages of using the low angle evaporation process.

SUMMARY OF THE INVENTION

In accordance with the principles of the present invention, there is disclosed herein a method of fabricating an emitter plate for use in a field emission device comprising the steps of providing an insulating substrate and forming a first conductive layer on the insulating substrate. This is followed by the steps of forming an insulating layer on the first conductive layer and forming a second conductive layer on the insulating layer. Then, a plurality of apertures are formed through the second conductive layer and through the insulating layer. A lift-off layer is then formed on the second conductive layer. The lift-off layer is formed by a plating process wherein the plating bath has a pH between 2.25 and 4.5, and current densities of 1 to 20 $mA/Cm^2$. The method may further comprise depositing microtip material through the plurality of apertures to form a microtip in each of the plurality of apertures. The excess deposited overburden microtip material and the lift-off layer are then removed from the second conductive layer.

The methods disclosed herein for forming the microtips overcome limitations and disadvantages of the prior art display manufacturing methods. First, the use of the plating process to form the lift-off layer circumvents the slowdown in manufacturing time caused by the low angle evaporation process. In addition, by controlling the adhesion strength of the lift-off layer, the lift-off process consumes less time. Furthermore, the plating process of the present invention discourages microalloying of the gate and lift-off layer since the higher pH forms hydrous oxides at the gate and lift-off layer interface. As a result, the gate electrode is clean following the lift-off process. Finally, the plating process is less expensive than the low angle evaporation process, thereby lowering the overall cost of fabricating the flat panel display.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
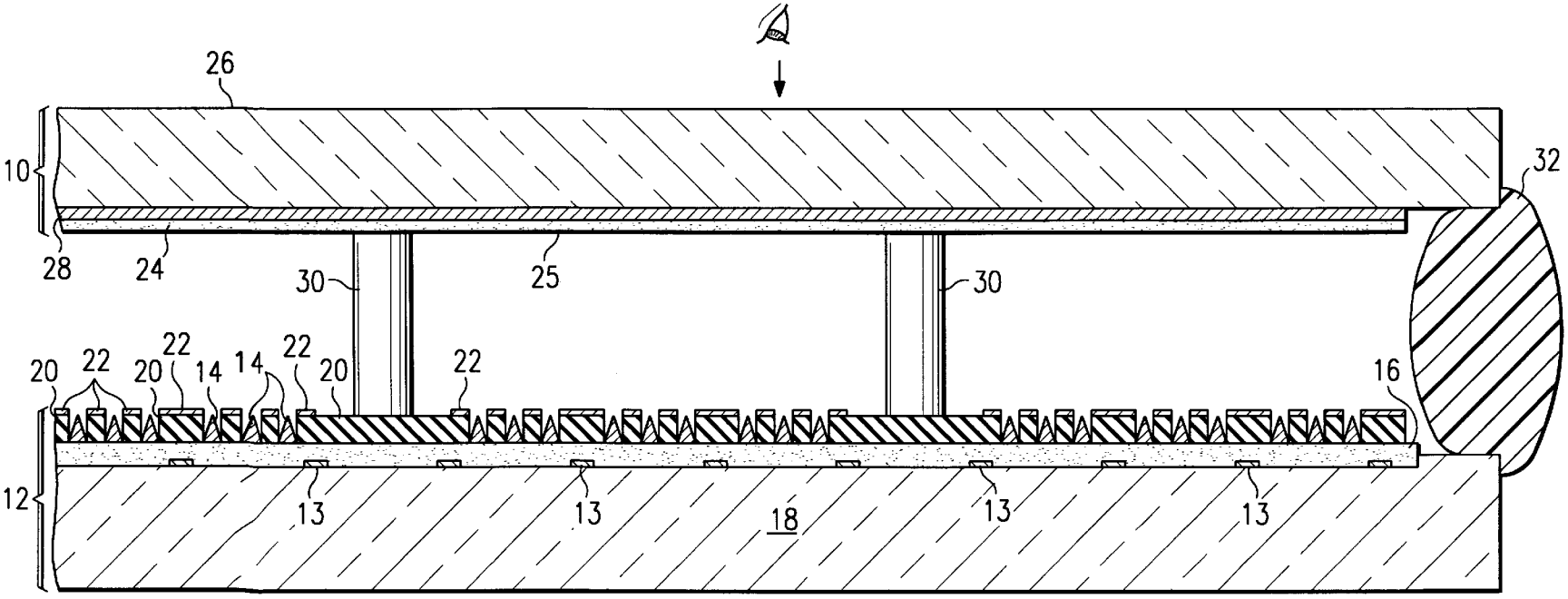
FIG. 1 is a cross-sectional view of a portion of a field emission flat panel display device fabricated in accordance with the present invention.
Figure 2:
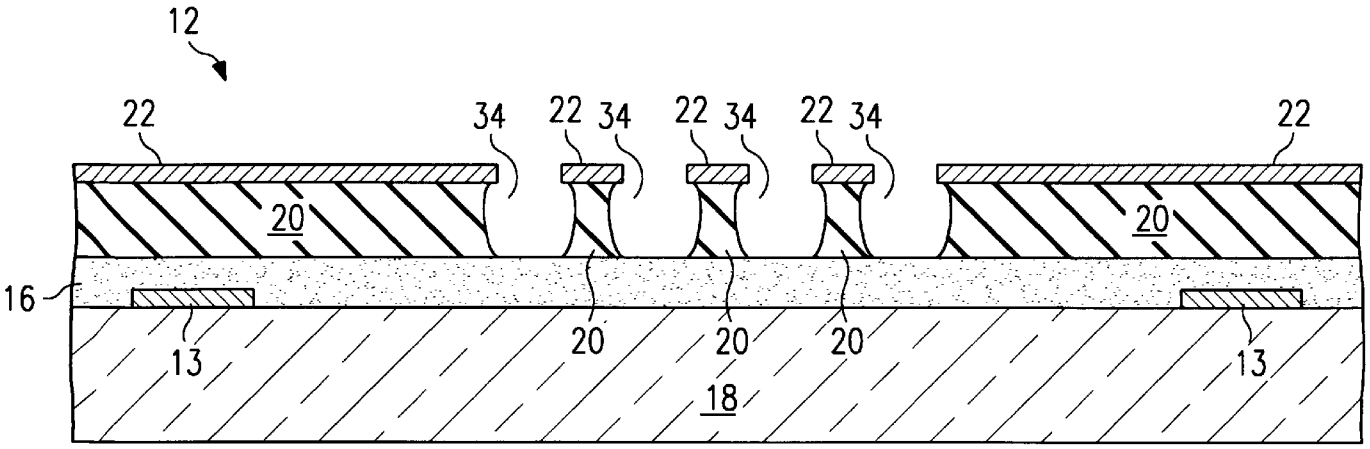
FIGS. 2 through 5 illustrate steps in a process for fabricating the emitter plate of FIG. 1 in accordance with the present invention.

Referring initially to FIG. 1, there is shown, in cross-sectional view, a portion of an illustrative field emission flat panel display device fabricated in accordance with the present invention. It is to be noted and understood that true scaling information is not intended to be conveyed by the relative sizes and positioning of the elements of anode plate 10 and the elements of emitter plate 12 as depicted in FIG. 1. In general, the field emission display device comprises an anode portion having an electroluminescent phosphor coating facing a cathode portion, the phosphor coating being observed from the side opposite to its excitation.

More specifically, the illustrative field emission device of FIG. 1 comprises a cathodoluminescent anode plate 10 and an electron emitter (or cathode) plate 12. The cathode portion of emitter plate 12 includes conductors 13 formed on an insulating substrate 18, a resistive layer 16 also formed on substrate 18 and overlaying conductors 13, and a multiplicity of electrically conductive microtips 14 formed on resistive layer 16. In this example, conductors 13 comprise a mesh structure, and microtip emitters 14 are configured as a matrix within the mesh spacings.

A gate electrode comprises a coating of an electrically conductive material 22 which is deposited on an insulating layer 20. Microtips 14 take the shape of cones which are formed within apertures through conductive layer 22 and insulating layer 20. The thicknesses of gate electrode coating 22 and insulating layer 20 are chosen in such a way that the apex of each microtip 14 is substantially level with the electrically conductive gate electrode coating 22. Conductive coating 22 may be in the form of a continuous coating across the surface of substrate 18; alternatively, it may comprise conductive bands across the surface of substrate 18.

Anode 10 comprises an electrically conductive film 28 deposited on a transparent planar support 26 which is positioned facing gate electrode 22. Conductive film 28 may be in the form of a continuous coating across the surface of support 26 as shown in FIG. 1; alternatively, it may be in the form of electrically isolated stripes comprising three series of parallel conductive bands across the surface of support 26, as taught in U.S. Pat. No. 5,225,820, to Clerc. By way of example, a suitable material for use as conductive film 28 may be indium-tin-oxide (ITO), which is optically transparent and electrically conductive.

Anode 10 also comprises a cathodoluminescent phosphor coating 24, deposited over conductive film 28 so as to be directly facing and immediately adjacent gate electrode 22. In the Clerc patent, the conductive bands of each series are covered with a phosphor coating which luminesces in one of the three primary colors, red, blue and green.

Anode 10 and cathode 12 are spaced apart from one another by a plurality of spacers 30 which are shown as columnar members. Spacers 30 may be made of ceramics, metals or polymers. However, glass is considered the most advantageous material for use as spacers 30.

Anode structure 10 and cathode structure 12 are sealed together at peripheral portions thereof by sealing material 32, illustratively comprising a glass frit rod which reflows at a temperature below the reflow temperature of spacers 30. The reflow temperature of sealing material 32 may be in the range of approximately 400–550° C.

During display operation, selected groupings of microtip emitters 14 are energized by applying a negative potential to layer 13, functioning as the cathode electrode, relative to the gate electrode 22, via a voltage supply (not shown), thereby inducing an electric field which draws electrons from the apexes of microtips 14. The freed electrons are accelerated toward the anode plate 10 which is positively biased by the application of a substantially larger positive voltage from a voltage supply (not shown) coupled between the gate electrode 22 and conductive film 28 functioning as the anode electrode. Energy from the electrons attracted to the anode conductive film 28 is transferred to particles of the phosphor coating 24, resulting in luminescence. The electron charge is transferred from phosphor coating 24 to conductive film 28, completing the electrical circuit to the voltage supply.

A method of fabricating an emitter plate for use in a field emission flat panel display device in accordance with the principles of the present invention comprises the following steps, considered in relation to FIGS. 2 through 5. The elements of FIGS. 2 through 5 which are numbered the same as elements of FIG. 1 are substantially identical to those elements of FIG. 1. The widths and thicknesses of the various layers and elements of FIGS. 2 through 5 are exaggerated and distorted, and no true scaling information should be perceived therefrom.

The initial manufacturing steps of emitter plate 12 which follow are known in the art. Referring now to the illustration of FIG. 2, an insulating glass substrate 18 is first coated with a thin insulating layer (not shown). Illustratively, the insulating layer is $SiO_2$, which may be sputter deposited to a thickness of 50 nm. Conductive layer 13, which may typically comprise aluminum, molybdenum, chromium, or niobium, is deposited by either evaporation or sputtering over layer 18 to a thickness of approximately 100–500 nm. A patterned mask and photoresist may then be used to form conductive layer 13 into a mesh structure as disclosed in the Meyer ('780) patent. Next, a resistive layer 16 is added by sputtering amorphous silicon over the emitter plate 12 to a thickness of approximately 500–2000 nm; alternatively the amorphous silicon may be deposited by a chemical vapor deposition process.

Next, insulating layer 20, which is illustratively $SiO_2$, is deposited by either a sputtered or a chemical vapor deposition technique over resistive layer 16 to a thickness of approximately 1.0$\mu$. The gate electrode 22, which may typically comprise niobium, is then deposited by either evaporation or sputtering over insulating layer 20 to a thickness of approximately 0.4$\mu$.

The Borel et al. ('161) patent discloses an etching process for creating the apertures in the gate electrode material coating 22 and the insulating layer 20. The described process includes a reactive ionic etching of conductive coating 22 and insulating layer 20 using a sulfur hexafluoride ($SF_6$) plasma to form apertures 34. The insulating layer 20 is then undercut by chemical etching, e.g., by immersing the structure in a hydrofluoric acid and ammonium fluoride etching solution. The Borel et al. ('161) patent specifies that apertures 34 made in the conductive coating 22 should have a diameter of 1.3±0.1$\mu$. The diameter of apertures 34 through conductive coating 22 affects the final form of the microtip 14.

In accordance with the present invention, a lift-off layer having a controlled adhesion strength is now plated onto gate electrode 22. As a first step in the plating process, the surface of the gate electrode 22 is prepared for plating by three pre-treatments. The first pre-treatment involves placing the emitter plate 12 in oxygen plasma in order to burn away any organic material on the surface of the gate 22. The second pre-treatment consists of immersing the emitter plate 12 in a buffered oxide etch, illustratively, 7 parts 40% ammonium fluoride and 1 part 49% hydrofluoric acid. This pretreatment insures that the niobium oxide grown by the oxygen plasma is removed. The third pre-treatment involves dipping the emitter plate in 10% sulfuric acid to remove any oxide residue and ash which may be present on the gate electrode 22. This pre-treatment also desorbs the fluoride ions from the second pre-treatment. Reproducible preparation of the gate metal surface before plating is critical to the adhesive strength of the lift-off layer. Therefore, other pre-treatments may be more effective for other gate materials.

Further, in accordance with the present invention, the emitter plate 12 is then placed in a plating bath. The plating bath contains at least one metal capable of existing in two oxidation states. In the lower oxidation state, the metal is plated as the lift-off layer under the conditions further defined below. In the higher oxidation state, the metal is precipitated onto the gate metal surface as the hydroxide. Illustratively, the plating bath may contain an electrolyte of sulfuric acid, with a mixture of nickel and iron sulfates and/or nickel chlorides. Furthermore, the plating bath may be saturated with oxygen to create a controlled amount of ferric ions.

Brighteners and grain refiners are also contained in the bath; for example, boric acid and sodium saccharinate. Illustratively, the bath consists of 21.4 gm/L nickel sulfate hexahydrate, 50.0 gm/L nickel chloride hexahydrate, 3.4 gm/L ferrous sulfate heptahydrate, 25.0 gm/L boric acid, and 0.8 gm/L sodium saccharinate.

In accordance with the present invention, the pH of the plating bath is set to approximately 2.25 or higher in order to control the adhesion strength of the lift-off layer. Illustratively, the optimum pH is between 2.7 and 3.1. If the pH is too low, the lift-off layer 36 will be powdery, instead of a continuous film which advantageously withstands the microtip evaporation process. The desired pH is obtained by adding the quantity of sodium bicarbonate needed to obtain the pH level desired.

The current density during the plating process has a significant impact on the efficiency of the plating process and the adhesion strength of the lift-off layer 36. For example using a plating bath pH of 2.25 to 4.5, current densities of 5 to 15 mA/cm$^2$ provide optimum plating efficiency. Furthermore, current densities of 2 to 5 mA/cm$^2$ provide controlled adhesion of the lift-off layer 36. At current densities of 2 mA/cm$^2$ or less, undesirably strong adhesion occurs. In accordance with the present invention, the pH is illustratively 2.9+/−0.2 and the current density is illustratively 4 to 8 mA/cm$^2$.

With this plating process, gate electrode 22 of emitter plate 12 is the cathode, or negative pole. The counter electrode is a nickel, or nickel-iron plate. During the plating process the counter electrode is oxidized, and nickelous, or ferrous and nickelous, ions are released into the plating bath in proportion to the alloy of the counter electrode. The result is that electrons are pulled from the counter electrode and injected onto the conductive gate electrode 22 of the emitter plate 12, thereby forming the lift-off layer, which is illustratively 20% iron and 80% nickel.

Figure 3:
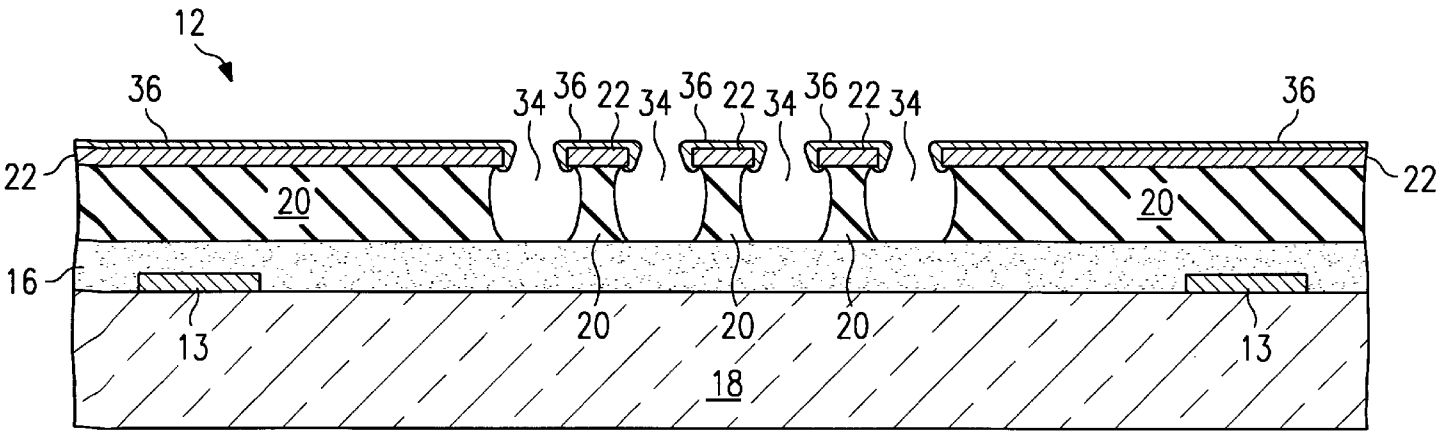

The result of the plating process is a lift-off layer 36 which covers all exposed surfaces of the gate electrode 22, as shown in FIG. 3. At a current density of approximately 6 mA/cm$^2$, the plating time is approximately 133 seconds for a lift-off layer which is approximately 150 nm thick.

Figure 4:
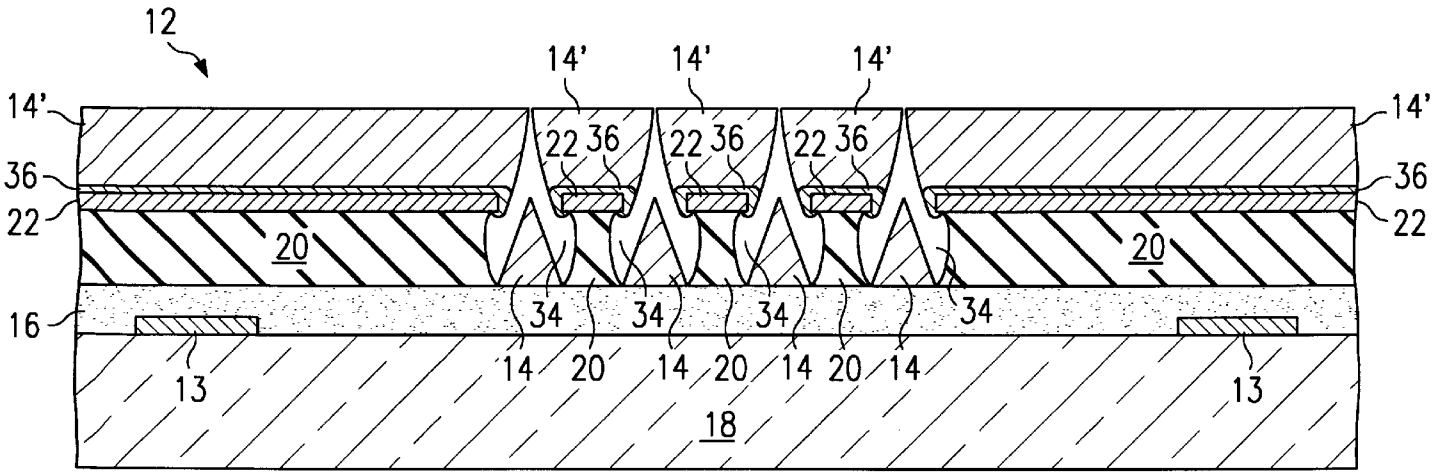

The next step in the manufacture of the emitter plate 12 is the formation of the microtip emitters 14, which may be as described in the Borel et al. ('161) patent. As shown in FIG. 4, the cone-shaped microtips 14 are formed by the deposition of a material coating, such as molybdenum, on the complete emitter plate 12 at a normal to slightly off-normal incidence. During the deposition process, the opening to aperture 34 narrows as the molybdenum coating simultaneously forms both the microtips 14 and the lift-off overburden 14'. The thickness of the microtips 14 is approximately 1.5$\mu$. The lift-off overburden 14' is approximately 2.0$\mu$.

The lift-off layer 36 is now dissolved as described below. During the dissolution of the lift-off layer 36, the lift-off overburden 14' is released, thereby exposing the perforated gate electrode 22 and the microtips 14.

In accordance with the present invention, the actual lift-off is accomplished electrochemically. Illustratively, the lift-off procedure involves controlled potential anodic stripping with an electrolyte, 3.7 wt. % hydrochloric acid solution, and a 0.01% nonionic wetting agent at room temperature. With this potentiostatic lift-off process, gate electrode 22 of emitter plate 12 is the working electrode and is charged to approximately 0.2 V. The reference electrode could be a saturated calomel electrode or a silver wire, and the counter electrode is a nickel, or stainless steel, plate.

Figure 5:
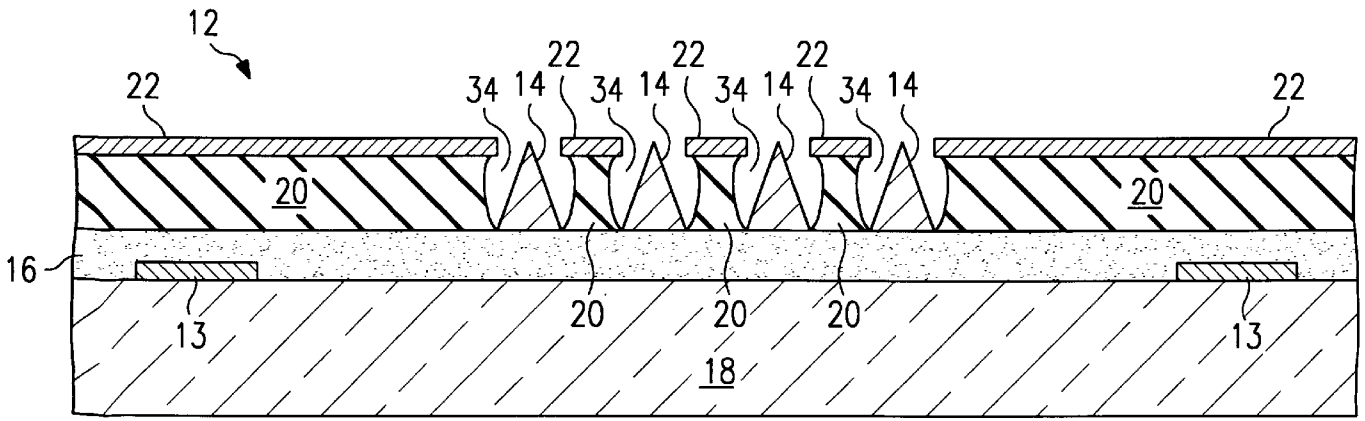

During the lift-off process, the electrolyte must get access to the lift-off layer 36 through the small hole left in the center of the overburden material 14'. Once the electrolyte gains access to the lift-off layer 36, the refresh process causes chloride ions to combine with the nickel-iron lift-off layer 36, thereby dissolving the lift-off layer 36. As the lift-off layer 36 dissolves, the overburden 14' flakes off into the bottom of the bath. During the lift-off process the density of the current applied to the working electrode is initially around 6 mA/cm$^2$ and the process is discontinued when the current has fallen to around 0.01 mA/cm$^2$ (indicating that all of the nickel-iron has been dissolved). This lift-off process takes approximately 20 minutes. FIG. 5 shows the structure of emitter plate 12 after the lift-off process has been completed.

Several other variations in the above processes, such as would be understood by one skilled in the art to which it pertains, are considered to be within the scope of the present invention. As a first such variation, the lift-off layer may comprise other materials, such as nickel alone. Also, the current density during plating may be adjusted for the desired strength of the adhesion of the lift-off layer to the gate electrode. Specifically, if the current density is increased the adhesion strength will lessen, because more defects will be introduced into the interface between the gate electrode and the plated film. Conversely, if the current density is decreased, the adhesion of the lift-off layer to the gate electrode will strengthen.

Additionally, the pH of the plating bath may be adjusted to achieve the desired adhesion between the lift-off layer and the gate electrode. Similarly, other additives and grain refiners may be used during plating to optimize the properties of the plated film.

Furthermore, more than one material my be evaporated to form the microtips. For example, the microtips may be comprised of niobium coated with molybdenum or any other low work function material. Lastly, the lift-off layer and overburden material may be removed by other procedures well known in the art, such as sonic bath, water spray, or air gun.

The methods disclosed herein for forming the microtips overcome limitations and disadvantages of the prior art display manufacturing methods. First, the use of the plating process to form the lift-off layer circumvents the slowdown in manufacturing time caused by the low angle evaporation process. In, addition, by controlling the adhesion strength of the lift-off layer, the lift-off process consumes less time. Furthermore, the plating process of the present invention discourages microalloying of the gate and lift-off layer since the higher pH forms hydrous oxides at the gate and lift-off layer interface. As a result, the gate electrode is clean following the lift-off process. Finally, the plating process is less expensive than the low angle evaporation process, thereby lowering the overall cost of fabricating the flat panel display.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A method of fabricating an emitter plate for use in a field emission display device, said method comprising the steps of:

providing an insulating substrate;

forming a first conductive layer on said insulating substrate;

forming an insulating layer on said first conductive layer;

forming a second conductive layer on said insulating layer;

forming a plurality of apertures through said second conductive layer and through said insulating layer;

forming a lift-off layer on said second conductive layer, said lift-off layer formed by an electroplating process wherein a plating bath comprises at least one metal capable of existing in two oxidation states; and wherein said plating bath is saturated with oxygen.

2. The method in accordance with claim 1 further comprising the steps of:

depositing conductive material through said plurality of apertures to form a microtip in each of said plurality of apertures; and removing said deposited conductive material and said lift-off layer from said second conductive layer.

3. The method in accordance with claim 2 wherein said deposited conductive material and said lift-off layer are removed by electrochemical dissolution using hydrochloric acid.

4. The method in accordance with claim 1 wherein said lift-off layer comprises nickel.

5. The method in accordance with claim 1 wherein said lift-off layer comprises nickel and iron.

6. The method in accordance with claim 1 wherein said plating bath further comprises boric acid.

7. The method in accordance with claim 1 wherein said plating bath further comprises sodium saccharinate.

8. The method in accordance with claim 1 wherein said plating bath comprises sulfate and chloride salts of nickel, and sulfate salts of ferrous iron.

9. The method in accordance with claim 1 wherein said plating process uses current densities between 4 and 8 $mA/cm^2$.

10. The method in accordance with claim 1 wherein said plating bath has a pH between 2.7 and 3.1.

11. The method in accordance with claim 1 wherein said lift-off layer is approximately 150 nm thick.

12. The method in accordance with claim 1 wherein said lift-off layer comprises 20% iron and 80% nickel.

13. The method in accordance with claim 1 wherein said plating process is galvanostatically controlled.

14. The method in accordance with claim 1 further comprising the step of removing the lift-off layer with a potentiostatically controlled anodic dissolution process.

15. The method in accordance with claim 1 wherein said plating bath has a pH between 2.25 and 4.5 and wherein said plating process has a current density between 1 to 20 $mA/cm^2$.

16. The method in accordance with claim 1 wherein said lift-off layer comprises permalloy.

17. A method of fabricating an emitter plate for use in a field emission display device, said method comprising the steps of:

providing an insulating substrate;

forming a first conductive layer on said insulating substrate;

forming an insulating layer on said first conductive layer;

forming a second conductive layer on said insulating layer; forming a plurality of apertures through said second conductive layer and through said insulating layer;

forming a lift-off layer on said second conductive layer, said lift-off layer formed by an electroplating process wherein a plating bath comprises at least one metal capable of existing in two oxidation states; and wherein said plating process uses current densities between 4 and 8 $mA/cm^2$, and further wherein said plating bath is saturated with oxygen.

18. A method of fabricating an emitter plate for use in a field emission display device, said method comprising the steps of:

providing an insulating substrate;

forming a first conductive layer on said insulating substrate;

forming an insulating layer on said first conductive layer;

forming a second conductive layer on said insulating layer;

forming a plurality of apertures through said second conductive layer and through said insulating layer;

forming a lift-off layer on said second conductive layer, said lift-off layer formed by an electroplating process wherein a plating bath comprises at least one metal capable of existing in two oxidation states; and wherein said plating bath has a pH between 2.6 and 3.1, and further wherein said plating bath is saturated with oxygen.

* * * * *